US011684171B2

(12) United States Patent
Bradshaw

(10) Patent No.: US 11,684,171 B2
(45) Date of Patent: Jun. 27, 2023

(54) HIGHCHAIR WITH AN AUTOMATED TRAY

(71) Applicant: Jodi Bradshaw, Greer, SC (US)

(72) Inventor: Jodi Bradshaw, Greer, SC (US)

( * ) Notice: Subject to any disclaimer, the term of this patent is extended or adjusted under 35 U.S.C. 154(b) by 0 days.

(21) Appl. No.: 17/569,909

(22) Filed: Jan. 6, 2022

(65) Prior Publication Data

US 2022/0211191 A1 Jul. 7, 2022

Related U.S. Application Data

(60) Provisional application No. 63/134,706, filed on Jan. 7, 2021.

(51) Int. Cl.
*A47D 1/00* (2006.01)

(52) U.S. Cl.
CPC ..... *A47D 1/002* (2013.01); *A47D 1/0081* (2017.05)

(58) Field of Classification Search
CPC ..... A47C 1/0242; A47C 7/70; A47C 7/622; B64D 11/0638; B64D 11/0605; A47D 1/023; A47D 1/002
USPC ..... 297/160–162
See application file for complete search history.

(56) References Cited

U.S. PATENT DOCUMENTS 4,768,825 A 9/1988 Quinlan, Jr.
4,958,885 A 9/1990 Kassai
5,238,292 A 8/1993 Golenz et al.
5,507,550 A 4/1996 Maloney
5,806,922 A 9/1998 Mendelovich
6,416,124 B1 7/2002 Chen et al.
7,883,145 B2 2/2011 Troutman et al.
9,986,850 B2 6/2018 Haut et al.
10,137,990 B2 * 11/2018 Lee ..... B61D 33/005
10,300,825 B2 * 5/2019 Akaike ..... B61D 33/00
10,926,880 B1 * 2/2021 Mayne ..... A47B 31/06
11,013,332 B2 * 5/2021 Xiao ..... A47C 7/70
2006/0207021 A1 * 9/2006 Brunson ..... A61B 90/60 5/81.1 R
2006/0220349 A1 10/2006 Wolf et al.
2016/0135598 A1 * 5/2016 Andoloro ..... A47C 1/0308 297/135
2017/0251826 A1 9/2017 Sclare et al.
2020/0100594 A1 * 4/2020 Fietz ..... A47C 1/0307

* cited by examiner

*Primary Examiner* — Sarah B McPartlin
(74) *Attorney, Agent, or Firm* — Allen, Dyer et al.

(57) ABSTRACT

A highchair for seating a child includes a seat configured for a child to sit, and a frame having a first side and a second side where the frame is attached to and supporting the seat at a height. The highchair also includes a tray rotatably secured to the first side of the frame, a tray adjustment mechanism comprising a motor, and a bracket secured to the tray. In addition, a connector is coupled between the tray adjustment mechanism and the bracket where the connector is configured to be extended or retracted by the motor to adjust a position of the tray over the seat. A battery is configured to power the tray adjustment mechanism and the motor comprises a stepper motor. The tray adjustment mechanism may also include a receiver so that the tray can be activated using a wireless signal or voice command.

16 Claims, 4 Drawing Sheets

HIGHCHAIR WITH AN AUTOMATED TRAY

CROSS-REFERENCE TO RELATED APPLICATIONS

This application claims priority to U.S. Provisional Application Ser. No. 63/134,706 filed on Jan. 7, 2021 the contents of which are herein incorporated by reference in their entirety.

FIELD

The present invention relates to the field of highchairs for children, and, more particularly, to a highchair with an automated tray.

BACKGROUND

Highchairs provide a raised seat for children so that they are at the same height as a table. A removable eating tray is often used so that the child does not eat directly off the table but from his or her own tray.

While the tray has been a beneficial attachment and improvement to highchairs, the tray can also be an impediment. For example, when the adult is placing the child into the highchair, the tray must be up. However, often times the tray may be down and the adult has their hands full holding the child. The adult has to then place the child down, move the tray up, and pick the child back up in order to place them into the highchair. This can be a disruptive process to the child and physically straining to the adult.

Accordingly, there is a need for a highchair that has an improved tray configuration and that is easy to use for adults.

SUMMARY

A highchair for seating a child is disclosed. The highchair includes a seat configured for a child to sit, and a frame having a first side and a second side. The frame is attached to and supporting the seat at a height. A tray is rotatably secured to the first side of the frame, and an electrically driven tray adjustment mechanism is coupled to the tray and configured to rotate the tray from a down position over the seat to a raised up position. In addition, the highchair may include a pedal coupled to a lower portion of the frame and configured to be pushed by a foot, where the pedal is in electrical communication with the electrically driven tray adjustment mechanism and causes the tray to alternately rotate between the down position over the seat to the raised up position when pushed. The electrically driven tray adjustment mechanism may also be actuated by a voice command and comprise a motor coupled to a linear actuator. In a particular aspect the motor comprises a stepper motor.

The highchair may include a bracket secured to the tray, and the bracket may have a spindle passing therethrough. A connector may be coupled between the electrically driven tray adjustment mechanism and the bracket, where the connector is configured to be retracted by the electrically driven tray adjustment mechanism to cause the tray to rotate about the spindle to the raised up position. Similarly, the connector is configured to also be extended in the opposing direction by the electrically driven tray adjustment mechanism to cause the tray to rotate to the down position over the seat.

A battery may be used to power the electrically driven tray adjustment mechanism or an alternative source of power such as a wall outlet may be used. The connector may comprise a cable or rod, for example, and be relatively rigid. The frame of the highchair may have four legs that are configured to be collapsed together for storing the highchair and the tray may also be removable from the frame. The electrically driven tray adjustment mechanism may be secured under the seat of the highchair or in any other suitable location.

In another aspect, a highchair for seating a child includes a seat configured for a child to sit, a frame having a first side and a second side, where the frame is attached to and supporting the seat at a height, and a tray is rotatably secured to the first side of the frame. The highchair also includes an electrically driven tray adjustment mechanism comprising a motor where the electrically driven tray adjustment mechanism is coupled to the tray and configured to rotate the tray from a down position over the seat to a raised up position.

In another aspect, a highchair for seating a child includes a seat, a frame having a first side and a second side, where the frame is attached to and supporting the seat, and a tray rotatably secured to the first side of the frame. The highchair includes a tray adjustment mechanism comprising a motor, a bracket secured to the tray, and a connector coupled between the tray adjustment mechanism and the bracket. The connector is configured to be extended or retracted by the motor to adjust a position of the tray over the seat.

In addition, the tray adjustment mechanism may include a receiver so that the tray can be activated using a wireless signal such as Bluetooth, wi-fi, or Alexa, for example.

Other aspects, advantages, and features of the present disclosure will become apparent after review of the entire application, including the following sections: Brief Description of the Drawings, Detailed Description, and the Claims.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
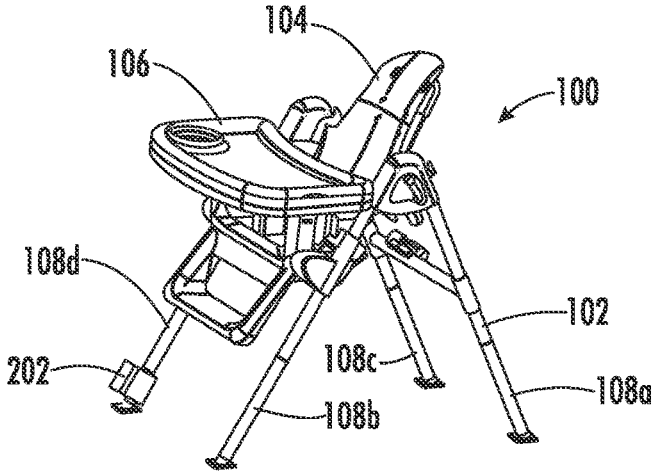
FIG. 1 is a top perspective view of a highchair with an automated tray in which various aspects of the disclosure may be implemented.
Figure 2:
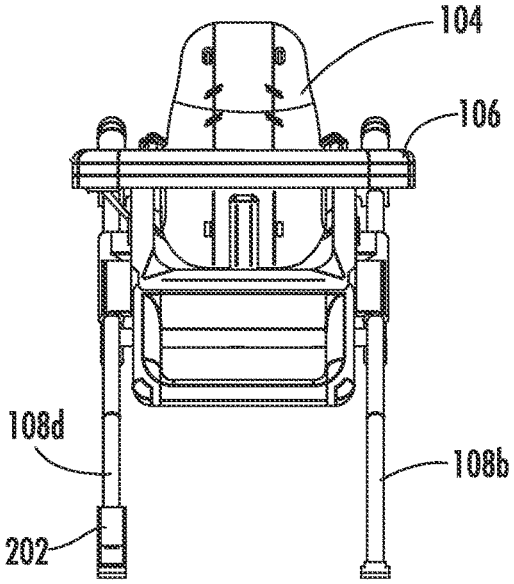
FIG. 2 is a front view of the highchair of FIG. 1.
Figure 3:
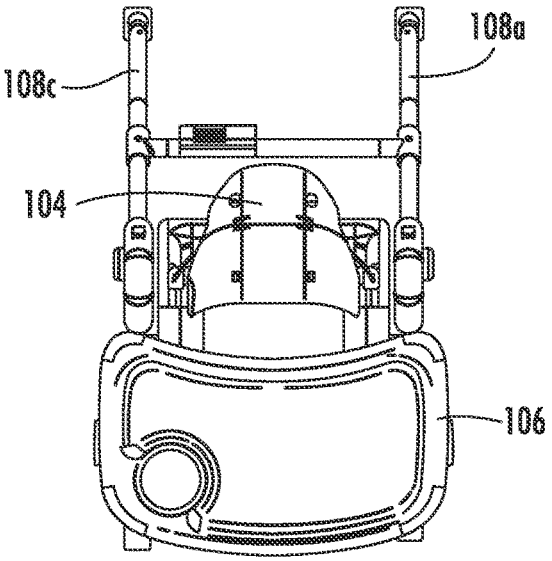
FIG. 3 is a top view of the highchair of FIG. 1.

Referring now to FIGS. 1-3, a highchair with an automated tray, generally designated 100, includes a frame 102, a seat 104, and a tray 106 rotatably coupled to the frame 102. The frame 102 provides the structural support for the seat 104 that holds the child. In a particular aspect, the frame 102 comprises four legs 108*a*, 108*b*, 108*c*, 108*d*.

A pedal 202 is secured to one of the legs (e.g. 108*d*) of the frame 102 and is configured to activate the movement of the tray 106. The pedal 202 is positioned so that it can be pushed with a foot of an adult while holding a child. The pedal 202 is in electrical communication with an electrically driven tray adjustment mechanism 302 that causes the tray 106 to alternately rotate between the down position to the raised up position when pushed. The child can be placed in the seat 104 of the highchair 100 when the tray 106 is rotated to an up position.

Figure 4:
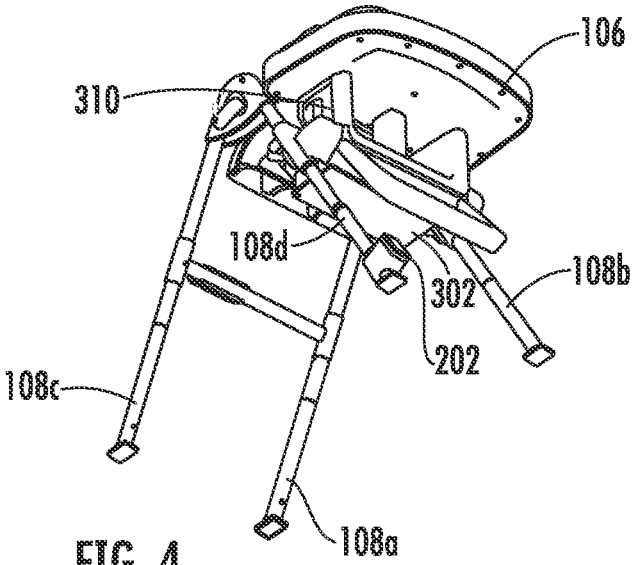
FIG. 4 is s bottom perspective view of the highchair of FIG. 1.
Figure 5:
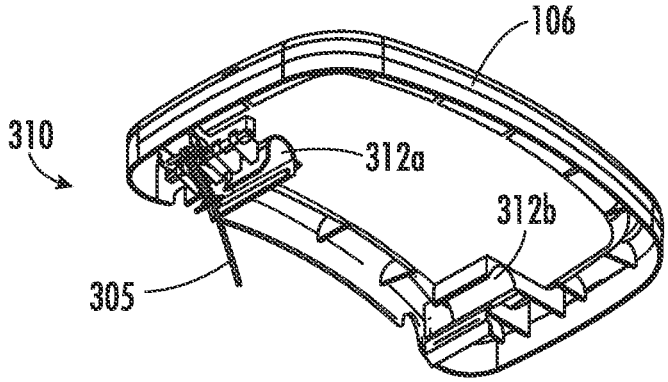
FIG. 5 is a bottom perspective view of a tray of the highchair of FIG. 1.
Figure 7:
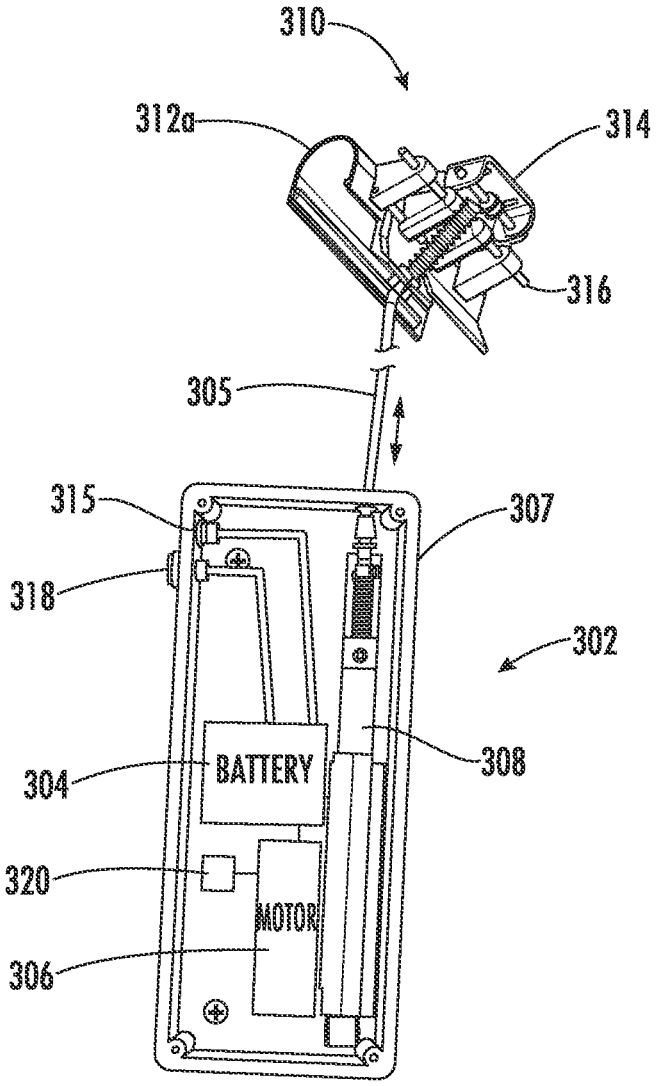
FIG. 7 is a detailed view of an electrically driven tray adjustment mechanism of the highchair of FIG. 1.

Referring now to FIG. 4, the electrically driven tray adjustment mechanism ("tray adjustment mechanism") is shown secured under the seat 104. FIG. 5 illustrates the tray 106 having a lower cover removed so that a bracket 310 secured to the tray 106 is visible. The bracket 310 has a spindle 316 passing therethrough as best seen in FIG. 7 and allows one side of the tray 106 to serve as the pivot location about which the tray 106 rotates. Also, the tray 106 includes a pair of friction fit receivers 312*a*, 312*b* that are used to clamp each side of the tray 106 to the frame 102 of the highchair 100.

Figure 6:
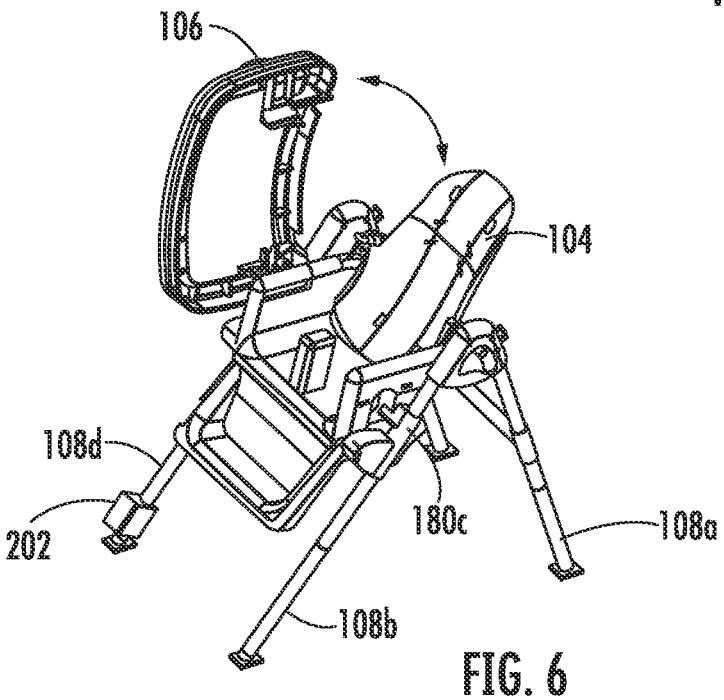
FIG. 6 is a top perspective view of the highchair of FIG. 1 having the tray in a raised up position.

A connector 305 is coupled to the bracket 310 as shown in FIG. 5, and to the electrically driven tray adjustment mechanism 302. The connector 305 is configured to be retracted by the electrically driven tray adjustment mechanism 302 that is located under the seat 104 to cause the tray 106 to rotate about the spindle 316 to the raised up position as shown in FIG. 6. Likewise, the connector 305 is configured to be extended by the electrically driven tray adjustment mechanism 302 in the opposing direction to cause the tray 106 to rotate to the down position over the seat 104.

Referring now to FIG. 7, the tray adjustment mechanism is coupled to the connector 305. In particular, the connector 305 is coupled to a motor 306. As explained above, the electrically driven tray adjustment mechanism 302 causes the tray 106 to rotate up when the pedal 202 is pushed by retracting the connector 305. Thus, moving the tray 106 to the up position in a hands free operation and allows the adult to hold the child with both hands to place the child in the seat 104. In addition, the electrically driven tray adjustment mechanism 302 may include a receiver 320 so that the tray 106 can be activated using a wireless signal or audio command such as Bluetooth, wi-fi, or Alexa, for example.

The connector 305 has a top end that is connected to the bracket 310 of the tray 106. The bracket 310 includes a top portion 314 that is secured to the tray 106 and also to the top end of the connector 305. A bottom end of the connector 305 is connected to a linear actuator 308 of the electrically driven tray adjustment mechanism 302. The connector 305 may be a cable or rod, for example, and rigid in its longitudinal direction.

Figure 8:
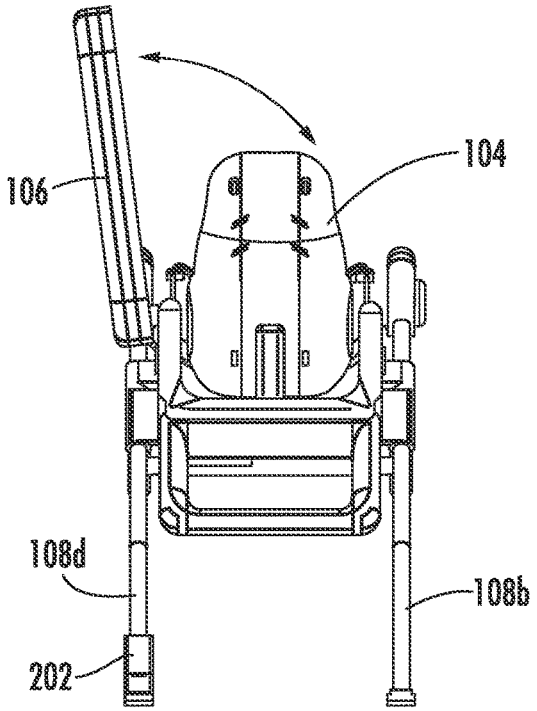
FIG. 8 is a front view of the highchair of FIG. 1 with the tray in the raised-up position.

The electrically driven tray adjustment mechanism 302 is shown in more detail in FIG. 7 and includes a case 307. In particular, the tray adjustment mechanism 302 includes a battery 304 that is in electrical communication with an electric motor 306. The battery 304 may be recharged using the charge port 315, and an on/off switch 318 may also be configured to switch the tray adjustment mechanism 302 on and off. The electric motor 306 may be configured to drive the linear actuator 308 that is connected to the bottom end of the connector 305. Accordingly, when the connector 305 is retracted by the linear actuator 308, that in turn causes the tray 106 to rotate to the raised up position as shown in FIG. 8.

Likewise, when the connector 305 is extended by the linear actuator 308, that in turn causes the tray 106 to rotate to the down position. As those of ordinary skill in the art can appreciate, the connector 305 may be retracted and extended using different configurations of elements and type of motors. Accordingly, the description provided herein is exemplary in nature rather than limiting. The motor 306 may be a stepper motor, for example.

Figure 9:
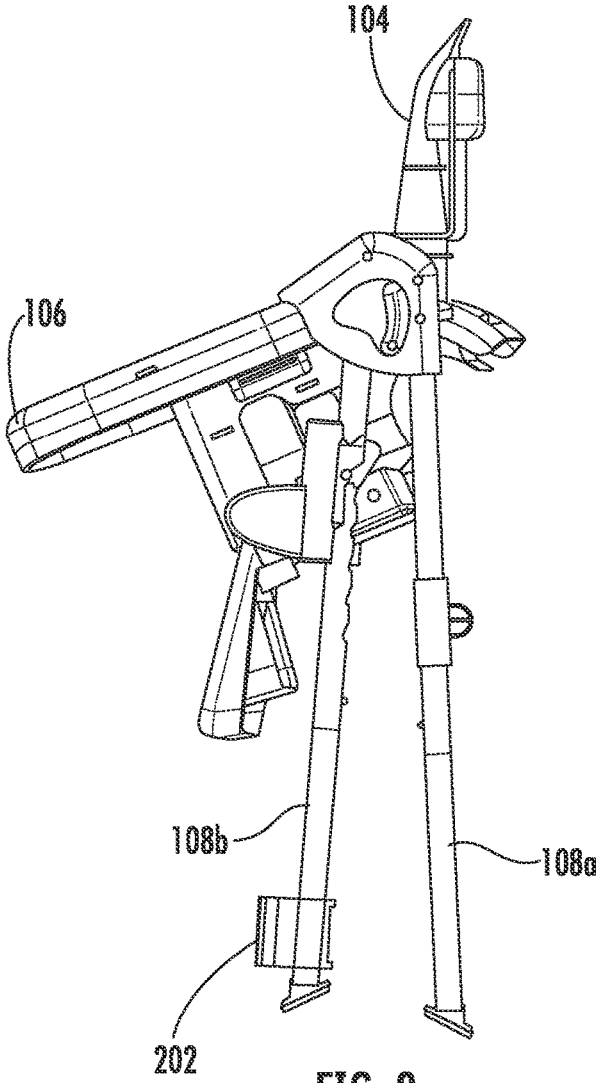
FIG. 9 is an elevational view of the highchair of FIG. 1 in a stowed position.

Referring now to FIG. 9, the highchair 100 is shown with the frame 104 in a folded and stowed position. The four legs 108*a*, 108*b*, 108*c*, 108*d* are configured to collapse the four legs together for storing the highchair. The tray 106 can also be removed and snapped to one of the legs of the frame 102. Accordingly, the highchair 100 is compact and is easily stored.

The previous description of the disclosed embodiments is provided to enable any person skilled in the art to make or use the disclosed embodiments. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope possible consistent with the principles and novel features as defined herein.

That which is claimed is:

1. A highchair for seating a child comprising:

a seat configured for a child to sit;

a frame having a first side and a second side, the frame attached to and supporting the seat at a height;

a tray rotatably secured to the first side of the frame;

an electrically driven tray adjustment mechanism coupled to the tray and configured to rotate the tray from a down position over the seat to a raised up position; and a pedal coupled to a lower portion of the frame and configured to be pushed by a foot, wherein the pedal is in electrical communication with the electrically driven tray adjustment mechanism and causes the tray to alternately rotate between the down position over the seat to the raised up position when pushed.

2. The highchair of claim 1, wherein the electrically driven tray adjustment mechanism is actuated by a voice command.

3. The highchair of claim 1, wherein the electrically driven tray adjustment mechanism comprises a motor coupled to a linear actuator.

4. The highchair of claim 1, wherein the electrically driven tray adjustment mechanism comprises a stepper motor.

5. The highchair of claim 1, further comprising a bracket secured to the tray, and the bracket having a spindle passing therethrough.

6. The highchair of claim 5, further comprising a connector coupled between the electrically driven tray adjustment mechanism and the bracket, wherein the connector is configured to be retracted by the electrically driven tray adjustment mechanism to cause the tray to rotate about the spindle to the raised up position, and the connector is configured to be extended by the electrically driven tray adjustment mechanism to cause the tray to rotate to the down position over the seat.

7. The highchair of claim 6, further comprising a battery configured to power the electrically driven tray adjustment mechanism.

8. The highchair of claim 7, wherein the connector comprises a cable.

9. The highchair of claim 1, wherein the frame comprises four legs and is configured to collapse the four legs together for storing the highchair.

10. The highchair of claim 9, wherein the tray is removable from the frame.

11. The highchair of claim 10, wherein the electrically driven tray adjustment mechanism is secured under the seat.

12. A highchair for seating a child comprising:

a seat configured for a child to sit;

a frame having a first side and a second side, the frame attached to and supporting the seat at a height;

a tray rotatably secured to the first side of the frame;

an electrically driven tray adjustment mechanism comprising a motor, the electrically driven tray adjustment mechanism coupled to the tray and configured to rotate the tray from a down position over the seat to a raised up position;

a bracket secured to the tray, and the bracket having a spindle passing therethrough; and a connector coupled between the electrically driven tray adjustment mechanism and the bracket;

wherein the connector is configured to be retracted by the electrically driven tray adjustment mechanism to cause the tray to rotate about the spindle to the raised up position, and the connector is configured to be extended by the electrically driven tray adjustment mechanism to cause the tray to rotate to the down position over the seat.

13. The highchair of claim 12, further comprising a battery configured to power the electrically driven tray adjustment mechanism.

14. A highchair for seating a child comprising:

a seat configured for a child to sit;

a frame having a first side and a second side, the frame attached to and supporting the seat at a height;

a tray rotatably secured to the first side of the frame;

a tray adjustment mechanism comprising a motor;

a bracket secured to the tray; and a connector coupled between the tray adjustment mechanism and the bracket, the connector configured to be extended or retracted by the motor to adjust a position of the tray over the seat.

15. The highchair of claim 14, further comprising a battery configured to power the tray adjustment mechanism.

16. The highchair of claim 14, wherein the tray adjustment mechanism comprises a receiver so that the tray can be activated using a wireless signal or voice command.

* * * * *